United States Patent [19]

Smith

[11] 4,210,999

[45] Jul. 8, 1980

[54] METHOD FOR WIRING ELECTRICAL BAYS

[75] Inventor: Arnold R. Smith, Chester, N.J.

[73] Assignee: Bell Telephone Laboratories, Incorporated, Murray Hill, N.J.

[21] Appl. No.: 924,153

[22] Filed: Jul. 13, 1978

Related U.S. Application Data

[62] Division of Ser. No. 801,587, May 31, 1977, Pat. No. 4,117,585.

[51] Int. Cl.[2] ..... H01R 43/04

[52] U.S. Cl. ..... 29/857

[58] Field of Search ..... 29/628, 753, 566.3, 29/564.6, 564.8, 627, 630 A, 629; 339/28, 148

[56] References Cited

U.S. PATENT DOCUMENTS

| | | | |
|---|---|---|---|
| 2,827,940 | 3/1958 | Davis et al. | 29/630 A |
| 3,230,608 | 1/1966 | Adams et al. | 29/628 |
| 3,459,878 | 8/1969 | Gressitt et al. . | |
| 3,579,823 | 5/1971 | Gressitt . | |
| 3,611,264 | 10/1971 | Ellis, Jr. . | |
| 3,631,378 | 12/1971 | Ellis, Jr. . | |
| 3,699,498 | 10/1972 | Hardesty et al. | 339/64 M |
| 3,836,415 | 9/1974 | Hilderbrandt . | |
| 3,839,787 | 10/1974 | Brown et al. | 29/629 |
| 3,842,496 | 10/1974 | Mercer . | |
| 3,859,724 | 1/1975 | Folkenroth . | |
| 3,864,802 | 2/1975 | Tucci . | |
| 3,875,662 | 4/1975 | Folk . | |
| 3,885,287 | 5/1975 | Long et al. . | |
| 4,001,931 | 1/1977 | McKee . | |

*Primary Examiner*—Carl E. Hall
*Assistant Examiner*—C. J. Arbes
*Attorney, Agent, or Firm*—Robert O. Nimtz

[57] ABSTRACT

A method and apparatus for semiautomatic wiring of telephone cabinets is disclosed which is suitable for twisted pairs of telephone wires. A pair-indexing head having a plurality of dual threaded spinning index rotors is used to permit automatic mass-termination of the individual wires in slotted-beam connectors. By pulling the connector block and attached wires down the length of the electrical cabinet, indexing the tip and ring conductors at the desired length, providing clamps at both ends of the twisted pairs, and cutting the wires, an operator is able to take the wires, one pair at a time, with proper tip and ring orientation, and terminate them on the back wiring plane of the electrical cabinet. The connector is then dressed through a wiring channel to exit at one end of the wiring cabinet and provide an easy means for connecting the cabinet to external wiring.

6 Claims, 7 Drawing Figures

METHOD FOR WIRING ELECTRICAL BAYS

This application is a division of Ser. No. 801,587, 5/31/77, now U.S. Pat. No. 4,117,585, granted Oct. 3, 1978.

BACKGROUND OF THE INVENTION

1. Field of the Invention

This invention relates to semiautomatic electrical wiring apparatus and methods and, more particularly, to rapid and accurate connections of twisted pairs to the backplane of an electrical cabinet.

2. Description of the Prior Art

Typical prior art methods for providing internal wiring in electrical cabinets include the separate fabrication by hand of a wiring harness which can then be mounted in the frame and the individual wire ends identified and terminated at the proper termination points within the cabinet. Not only is it expensive to produce the basic wiring harnesses in this fashion, but the efforts of the operator to identify wire ends to make the proper connections is also substantial. Finally, such techniques often involve considerable operator errors due to the tedious and repetitious nature of the process. Flat cable harnesses reduce some of these problems but still require operator identification and handling of each of the wires in order to accomplish termination.

Another common method for terminating wires in an electrical cabinet is an automatic computer-driven wire wrapping machine which automatically wraps the ends of wires around connector pins and routes the wires between these terminations. Such machines are extremely expensive and handle only a single wire at a time. Hence these machines are not suitable for twisted telephone pairs in which two wires must be routed together with the twist intact and yet each individual wire properly terminated at the appropriate connection point.

SUMMARY OF THE INVENTION

In accordance with the illustrative embodiment of the present invention, electrical cabinet wiring with twisted telephone pairs is accomplished using a pair indexing head to insure proper tip and ring selection and using a mass-terminating technique for simultaneously terminating a large number of twisted pairs in a slotted-beam connector block. The index head is used not only to align the tip and ring conductors appropriately for mass-termination at one end, but also to align these wires for sequential connection to various connection points on the back wiring plane of an electrical cabinet.

The index head may advantageously include a plurality of spinning rotors, each having a pair of threadways therein to receive the tip and ring conductors of a twisted pair. While the twisted pair is being pulled through the indexing head, the spinning rotors track the twist in the wires. A latching mechanism is used to lock the rotors in a preferred orientation to present the members of the pair in a preselected sequence and in a linear alignment. While thus aligned, the pairs can be mass-terminated in a slotted-beam connector block or can be taken, a pair at a time, in a preselected order for manual termination on the backplane of the electrical cabinet.

The major advantage of the present invention lies in the increased speed and reduced errors in backplane wiring due to the mass termination of one end of the wires and the presentation of the other ends of the wires to an operator in a specific preselected order of both pairs and of members of the pairs, thereby speeding the connections of these wires and reducing the likelihood of erroneous wire selection. In addition to these advantages, the methods and apparatus of the present invention reduce or eliminate the need for color coding or printed markings on the wire insulation. Finally, the methods and apparatus of the present invention are readily adaptable to continuous processing which, once started, permits the continuous wiring of electrical cabinets without rethreading the wires or any other start-up procedures.

DETAILED DESCRIPTION

Figure 1:
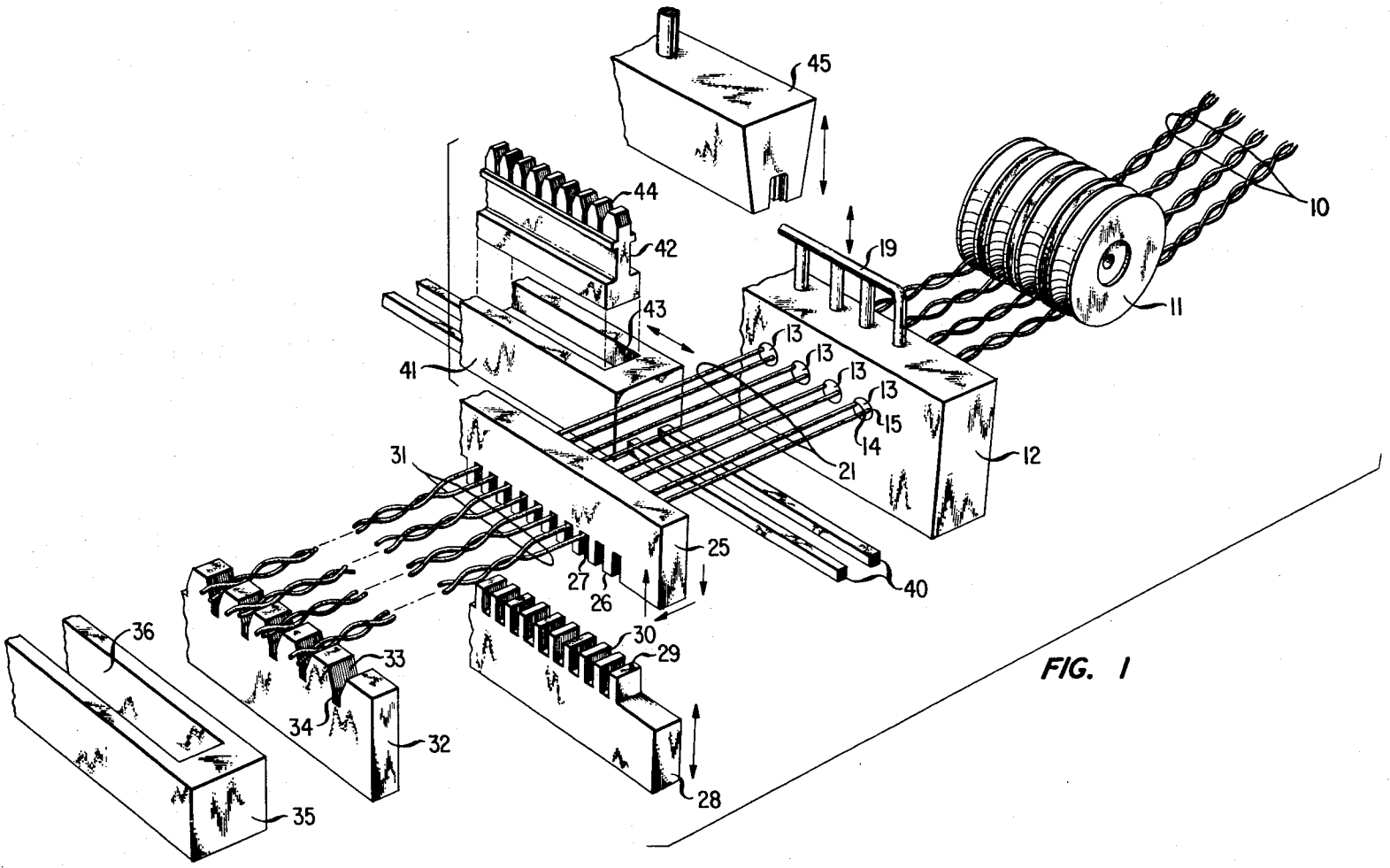
FIG. 1 is a perspective drawing of the major elements of the apparatus necessary to practice the methods of the present invention.

In FIG. 1 there is shown a perspective drawing of the major elements of the apparatus necessary for semiautomatic wiring of electrical cabinets using twisted pairs of telephone wires. A plurality 10 of insulated twisted pairs are supplied from supply reels, not shown, to an equal plurality of guide pulleys 11. Pulleys 11 are free to rotate on their central axes, supported by a supporting mechanism, not shown, to permit twisted pairs 10 to be fed in a properly spaced relationship from the supply reels to an indexing head 12.

Indexing head 12 includes a plurality of rotors 13, each of which includes a pair of threadways, such as threadways 14 and 15, through which the individual wires of a pair are threaded. The rotors 13 and associated mechanisms are shown more clearly in the detailed perspective cut-away view of FIG. 2.

Figure 2:
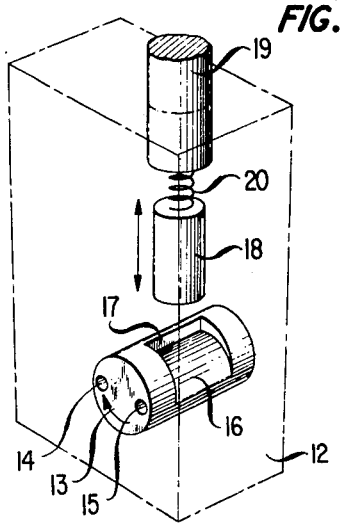
FIG. 2 is a detailed perspective drawing of one of the spinning rotors used in FIG. 1, showing the indexing mechanism.

Referring then to FIG. 2, the rotor 13 is supported in indexing head 12 by precision bearings, not shown, which permit rotor 13 to rotate freely with low friction in indexing head 12. Thus, when the individual wires of a twisted pair are threaded through threadways 14 and 15, rotor 13 is free to rotate and track the twist in the twisted pair.

The rotor 13 of FIG. 2 also includes a ramp 16 cut into the side of the rotor cylinder and which ends abruptly at a stop 17. The plane of stop 17 bears a known relationship to the common axis of threadways 14 and 15 and, indeed, in FIG. 2 is midway therebetween and perpendicular thereto. A lock pin 18 is mounted in indexing head 12 for sliding movement toward and away from rotor 13. When actuated in a downward direction, lock pin 18 engages ramp 16 and, under the influence of the clockwise rotation of rotor 13, eventually engages stop 17 and prevents further rotation of rotor 13. Lock pin 18 is operated by an operating arm 19 through a spring section 20 to permit lock pin 18 to slide down the ramp 16 and engage stop 17.

Returning to FIG. 1, it can be seen that the rotors 13 track the twists in twisted pairs 10 until actuating arm 19 is depressed, at which time a lock pin engages each of the rotors 13 and prevents further rotation. At this time, the two conductors of each twisted pair are oriented in a common plane and in a preselected sequence as between the two wires of each twisted pair, as shown at 21. This operation of presenting twisted pairs of wires in a fixed orientation is called "selective indexing.". A twisted pair indexing mechanism such as indexing head 12 is disclosed in T. J. Gressitt U.S. Pat. No. 3,579,823, granted May 25, 1971.

A comb structure 25 is provided with a plurality of equally spaced teeth 26, having gaps 27 therebetween. Teeth 26 of comb 25 are designed to fit conveniently between the threadways 14 and 15 of each of rotors 13, and between threadways in adjacent rotors in indexing head 12. Thus, when comb 25 is raised, moved upstream to a position adjacent to indexing head 12, and lowered, the teeth 26 will fit between the adjacent wires 21. As comb 25 is subsequently pulled downstream away from index head 12, the spatial separation and orientation of each of the wires 21 will be maintained upstream from comb 25 to indexing head 12 as shown in FIG. 1.

A second comb-like structure 28, located underneath comb 25, has a plurality of teeth 29 conforming in size and position to the openings 27, and a plurality of openings 30 conforming in size and position to the teeth 26. Thus, when comb 28 is raised, the various teeth and openings of combs 25 and 28 mate with each other so that the individual wires in openings 27 are firmly clamped by the tops of teeth 29. The upper surface of teeth 29 can be coated with a high-friction, slip-resistant material to insure a positive clamping action on the wires of twisted pairs 10. Together, combs 25 and 28 therefore form opposing jaws which, after the combing action, can be used to grasp the wires 21 and hold them securely.

It will be noted that, in the area downstream from comb 25, the pairs 31 again assume a twisted configuration since the normal twist in these pairs has been allowed to pass through indexing head 12 by the rotation of rotors 13. The untwisted configuration of the wires 21 extends only between indexing head 12 and comb 25 and persists only so long as the operating arm 19 forces the lock pins 18 (FIG. 2) to engage the rotors 13.

Downstream from comb 25 is a pair clamping block 32 having a plurality of V-shaped grooves 33 in the top surface thereof each positioned to receive one of twisted pairs 31. Grooves 33 each have a constricted lower portion 34 of sufficiently narrow dimensions to hold, by friction, a twisted pair which has been pulled down to the bottom 34 of a V-shaped groove 33.

Yet further downstream from pair holding block 32 is a connector holding device 35 having a rectangular opening 36 therein suitable for holding a slotted-beam electrical connector block (not shown) in a secure fashion, either by a press fit or by retaining springs or clamps (not shown). Connector holding device 35, wire clamping block 32, and indexing head 12 are all firmly secured to a work station base, not shown in FIG. 1, which insures that these elements remain stationary during the use of the apparatus.

Between indexing head 12 and comb 25 are a pair of tracks 40 upon which a second connector holding device 41 is free to slide in a direction perpendicular to the wires 21. Holding device 41 is adapted for holding a slotted-beam connector block 42 and is similar to holding device 35.

In operation, holding device 41 is slid on tracks 40 to the position shown in FIG. 1 and a connector block, such as block 42, is inserted into the holding cavity 43 of device 41. Holding device 41 is then slid back on tracks 40 to a position underneath the wires 21 between indexing head 12 and comb 25. Indeed, connecting block 42 is positioned precisely so that each of the openings 44 in the top of connector block 42 is positioned underneath one of the wires 21. A cutter-presser head 45 can then be lowered to force each of wires 21 into one of the slots 44 to engage the insulation-piercing end of a slotted-beam connector in block 42. Simultaneously, cutting blades on head 45 cut each of wires 21 at the downstream side of connector block 42, that is, on the side of connector block 42 closest to comb 25. The operation of cutter-presser head 45 can be more readily seen in the detailed perspective view of the bottom of cutter-presser head 45 shown in FIG. 3, together with the partial sectional view of FIG. 4.

Figure 3:
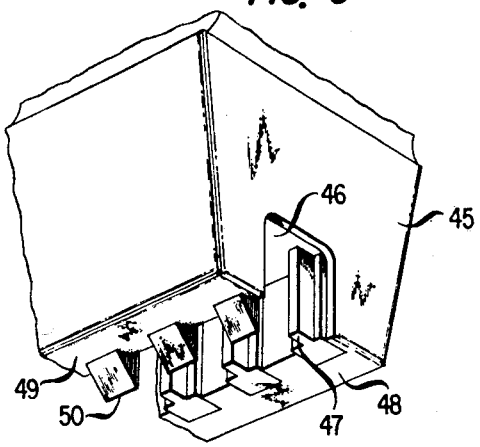
FIG. 3 is a detailed perspective drawing of a portion of the presser-cutter head used for mass-terminating the wires in FIG. 1.
Figure 4:
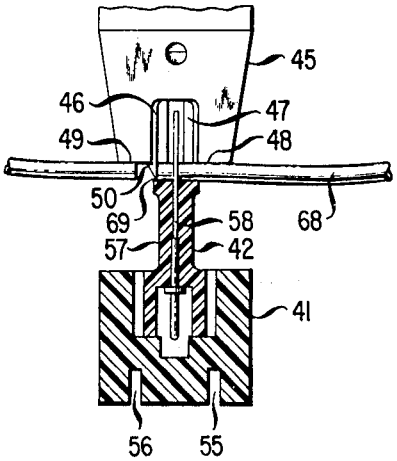
FIG. 4 is a cross-sectional view of the presser-cutter head in contact with a connector block during the terminating and cutting operations.

Turning first to FIG. 3, it can be seen that the bottom of cutter-presser head 45 has a longitudinal slot 46 cut therein of sufficient width and depth to fit over the upper portion of connector block 42 without engaging any portion of the connector block. A plurality of guides 47 projecting from the vertical inner walls of slot 46 are dimensioned and positioned to engage respective ones of the slots 44 at the top of connector block 42. It is to be understood that a guide identical to guide 47 is located on the opposite wall of slot 46 to engage the opposite side of slot 44 in block 42. Thus, when the cutter-presser head 45 is lowered, as shown in FIG. 4, the bearing surfaces 48 and 49 engage each of the wires 21 and force it down into one of the slots 44 on connector block 42. Guides 47 insure the precise alignment of the head 45 with slots 44.

In alignment with guides 47 are a plurality of cutter blades 50 having cutting edges disposed to cut through the aligned one of insulated conductors 21. The cutting and pressing action can be more readily understood by considering FIG. 4.

In FIG. 4 there is shown a partial sectional view of the cutter-presser head 45, connector block 42 and block holding device 41. It will be noted that holding device 41 includes channels 55 and 56 on its lower surface to engage tracks 40 in FIG. 1. Connector block 42 includes a molded insulative body portion 57 and a plurality of conductive slotted-beam connectors 58. Each of slotted-beam connectors 58, shown in a detailed perspective view in FIG. 5, includes a slotted-beam end 59 and a pin connector end 60. The slotted-beam end 59 includes beveled and tapered ends 61 and 62 which are formed by a coining trim tool into sharp insulation-piercing edges. A slot 63 receives and grips a wire forced therein. The two ends 61 and 62 are separated by an elongated and widened slot 64 to permit ends 61 and 62 to move resiliently and grasp the conductor of an insulated wire at slot 63 by means of spring action.

Figure 5:
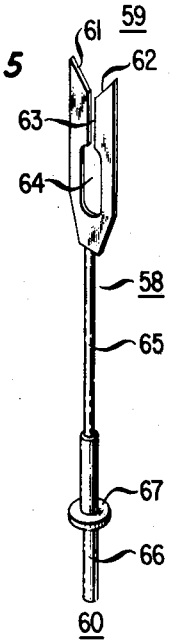
FIG. 5 is a perspective view of a combination slotted-beam pin connector used in the connector block of FIG. 1.

The slotted-beam end 59 of the connector of FIG. 5 is connected through a stem portion 65 to a pin connector end 66 designed to permit electrical contact between the pin 66 and a mating receptacle (not shown) in a mating connector block. Shoulder 67 at the pin connector end 60 of connector 58 serves to hold pin connector 68 in proper relationship to the insulating body 57 of the connector block 42.

Returning to FIG. 4, presser-cutter head 45 forces the insulated wire 68 between the tapered ends 61 and 62 of connector 58, cutting through the insulation around the central conductor. Further lowering of head 45 forces the conductor at the center of insulated wire 68 into the lot 63 where a low resistance electrical connection is made to the central conductor. At the same time, the cutting blade 50, cooperating with the shoulder 69 near the top of connector block 42, severs wire 68 at the left-hand or downstream side of connector block 42.

Having described the main elements of the apparatus necessary to practice the semiautomatic electric cabinet wiring method of the present invention, there remains to be described the actual steps of the method for performing such wiring. This method can be most easily described in connection with FIGS. 6 and 7 which are, respectively, plane and sectional views of a work station suitable for applying the semiautomatic wiring method of the present invention.

Figure 6:
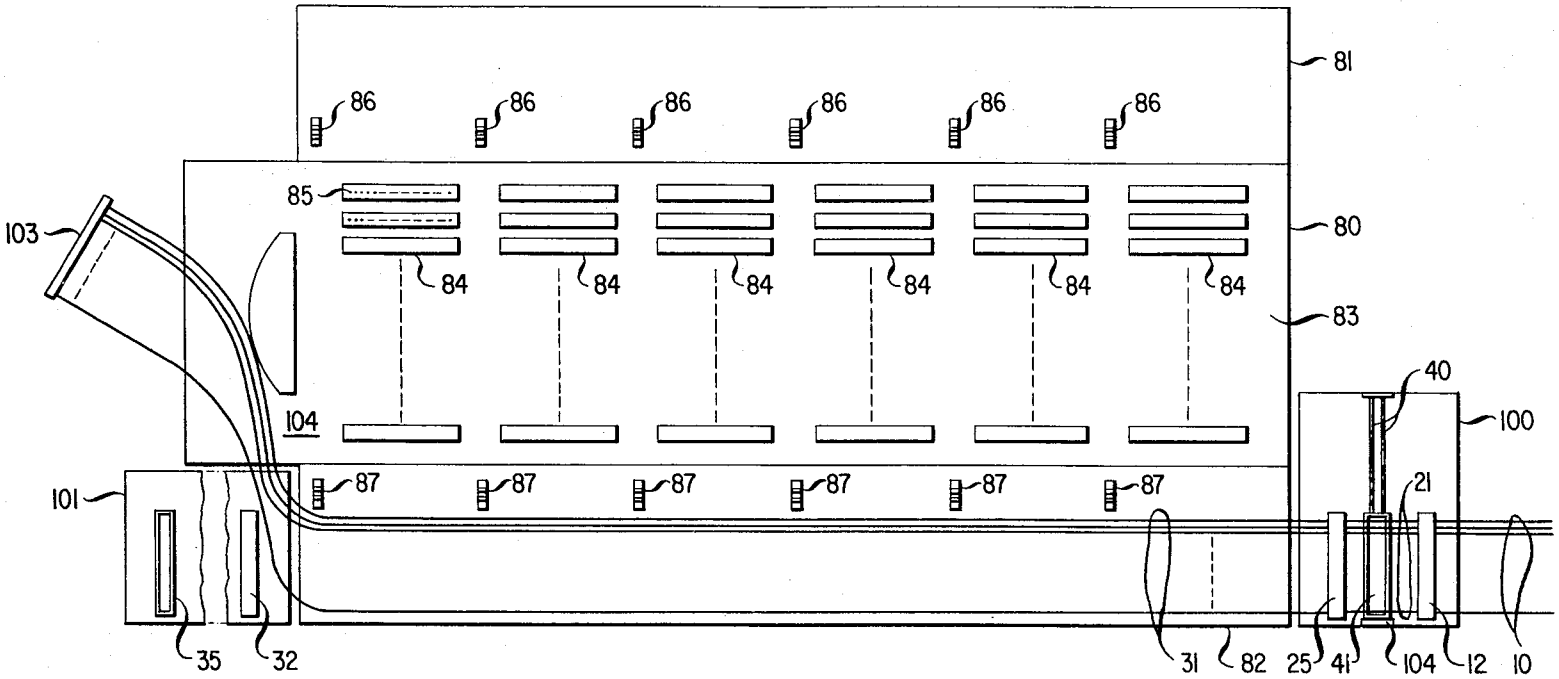
FIG. 6 is a typical work station layout utilizing the apparatus of FIG. 1 to make electrical terminations in an electrical cabinet.

In FIG. 6 there is shown a work station for semiautomatic wiring of electrical cabinets with twisted pairs illustrative of the apparatus and methods of the present invention. The work station of FIG. 6 includes an electrical cabinet 80 having two hinged flaps or doors 81 and 82 which can be opened to the position shown in FIG. 6 or can be closed like doors to cover a backplane wiring surface 83. Surface 83 includes a plurality of quick-connect type connector blocks 84 arranged in rows and columns and upon each of which are mounted a plurality of quick connectors such as connector 85. Details of cabinet 80 can be better seen in the cross-sectional view of FIG. 7.

Figure 7:
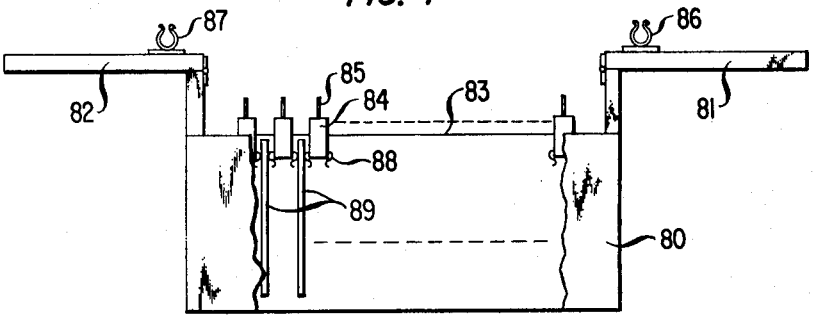
FIG. 7 is a cross-sectional view of the wired cabinet shown in FIG. 5.

Referring to FIG. 7, it can be seen that the electrical cabinet 80 and doors 81 and 82 are arranged to permit doors 81 and 82 to close and cover backplane wiring surface 83. Mounted on door 81 are a plurality of wire retaining clips 86 while a similar plurality of wire retaining clips 87 are mounted on door 82. Wire retaining clips 86 and 87 are mounted at convenient positions on doors 81 and 82, preferably as shown in FIG. 6 between the columns of quick connector blocks 84.

For purposes of illustration, the connector blocks 84 in FIG. 7 may include on their lower ends a pair of connector strips 88 suitable for engaging conductive surfaces on printed wiring boards 89. It can be seen, then, that cabinet 80 is suitable for mounting a very large plurality of printed wiring boards similar to boards 89 arranged in a plurality of rows, one above the other. Connections to the wiring boards are made at the lower edge of connector blocks 84. Electrical wiring between the printed wiring boards 89 can then be accomplished by interconnecting quick-connect connectors 85 along the backplane wiring surface 83. In this way, the appropriate electrical connections can be made between the circuits on printed wiring boards 89. Such intracabinet wiring may be accomplished by connectorized wiring harnesses as shown in W. J. Rhines et al U.S. Pat. No. 4,126,935, granted Nov. 28, 1978, filed of even date herewith and assigned to applicant's assignee.

In an electrical cabinet such as that shown in FIGS. 6 and 7, it is also necessary to make electrical connections between the printed wiring boards 89 and circuits external to cabinet 80. In order to permit prewiring of cabinet 80, it is desirable that these external connections be made through mating connector blocks so that the connections can be completed by mating the connector blocks at the installation site. The apparatus and method of the present invention has for its general object the rapid and error-free connection of terminal points on backplane wiring surface 83 to a plurality of connectors in order to accommodate such external connections to cabinet 80.

Returning to FIG. 6, the work station further includes two stationary tables 100 and 101 upon which the apparatus illustrated in detail in FIG. 1 is mounted. Thus, a plurality of twisted pairs 10 from supply reels and guide pulleys, not shown, are fed through indexing head 12 to comb structure 25. Between head 12 and comb 25, the individual wires of each pair are untwisted and aligned in the manner described in connection with FIGS. 1 and 2. Beyond comb 25 the twisted pairs 31 extend the entire length of cabinet 80 immediately above the surface of door 82. Clamping block 32 and connector block holding device 35 are mounted on table 101 at the opposite end of door 82. The distance between holding block 32 and connector holding device 35 is adjusted to provide a sufficient length of wires therebetween to permit a connector block such as connector block 103 to be brought out through a wiring channel 104 and exit at one end of cabinet 80. This end of cabinet 80 may be either the top or bottom of the wiring cabinet, depending on whether the external wiring is done through the floor or overhead in the room in which cabinet 80 is ultimately installed.

The work station of FIG. 6 can be used to provide the external wiring for cabinet 80 in accordance with the following procedures. In order to set up the apparatus of FIG. 6 for semiautomatic wiring, each of pairs 10 is taken from the supply reel and fed through the appropriate one of pulley guides 11 (Fig. 1) and the individual wires of the pair threaded through threadways 14 and 15 in one of the rotors 13 of indexing head 12. It is not important at this stage to insure any particular selection as between the wires of the twisted pairs since the indexing head 12 automatically assigns a precedence between the wires of the pair. This precedence is maintained automatically throughout the wiring procedure and hence the operator need take no affirmative actions to identify the conductors of each pair. For the same reason, neither the pairs nor the members of each pair need be marked or color-coded as an assistance for proper identification. Wire identification is entirely automatic throughout the wiring procedure to be described hereinafter.

After all of the twisted pairs 10 are threaded through indexing head 12, they are pulled out past comb 25 and the operating arm 19 is lowered to engage the lock pins 18 in each of the rotors 13. When all of the rotors 13 are latched, a preferred sequence of the twisted pairs has been achieved. At this time, comb 25 is raised, brought upstream to indexing head 12 and lowered between the individual wires 21. As comb 25 is thereafter pulled downstream, this preselected orientation of wires 21 is maintained in the space between indexing head 12 and comb 25. Comb 28, beneath comb 25, is then raised to grasp the individual wires and maintain the preselected orientation of wires 21.

At this time, the connector holding device 41 is slid on tracks 40 out from under wires 21 and loaded with a slotted-beam connector block such as connector 42 in FIG. 1. Holding device 41, together with connector block 42, is then slid back on tracks 40 against a stop 104 which holds connector block 42 in a position under wires 21 such that each of wires 21 is located immediately above one of the slots 44 on connector block 42. At this time, presser-cutter head 45 is lowered, connecting each of the wires 21 to one of the slotted-beam connectors 58 in connector block 42. At the same time, the wires downstream from connector block 42 are severed by blades 50 and the wire stubs still being held in comb 25 can be released by lowering comb 28 and raising comb 25. The wire stubs can be discarded. At this time, the preselected sequence in orientation of wires 21 are maintained by their connection in the slotted beam connectors 58 of terminal block 42.

The cutter-presser head 45 is now raised and the connector block 42 lifted out of holding device 41. At this time, operating arm 19 is raised to disengage lock pins 18 from the rotors 13 of indexing head 12. With rotors 13 now free to rotate, the terminal block 42 can be pulled downstream (to the left) across door 82 and placed in connector holding device 35 on table 101. Each pair is forced into a V-shaped groove 33 of holding block 32 and held by constrictions 34 at the bottoms of the grooves. The sequence of twisted pairs 31 is maintained over the entire length of door 82 by holding block 32 at the left-hand end and by rotors 13 in indexing head 12 at the right-hand end.

At this time, operating arm 19 is again lowered, latching rotors 13 and permitting comb 25 to orient the wires 21 of each pair in the area between indexing head 12 and comb 25. Combs 25 and 28 are then engaged to hold this orientation, holding device 41 is slid on tracks 40 out from under wires 21 and a second connector block similar to connector block 42 is inserted in device 41. Holding device 41 is then slid back under wires 21 againt stop 104 and cutter-presser head 45 is again lowered to interconnect wires 21 in the preferred orientation to the connector block. At the same time, wires 21 are cut by blades 50 on the downstream side of holding device 41.

It will be noted that, at this time, twisted pairs 31 are connected at one end to a connector block in holding device 35 and that the other end of the twisted pairs 31 are secured by comb 25 in a preferred orientation of both the twisted pairs and the individual members of each pair. It is now possible for an operator to take twisted pairs 31, one pair at a time, from combs 25 and 28, dress the twisted pair between retaining clips 87 and bring the free end of the twisted pair to the appropriate ones of connectors 85 on a selected one of connector blocks 84. The orientation of the two wires of each pair can be maintained throughout this manual operation so that a pair, with proper orientation, can be connected to an adjacent pair of connectors 85 in the same connector block 84. Although a tool might be useful for holding the wires of the pair in the proper orientation, it is not difficult for an operator to hold the wires of pair manually in such a fashion as to maintain the orientation.

It will be noted that combs 25 and 28 hold the wires of pairs 31 so that they can be pulled loose by the exertion of moderate tension at the downstream side of comb 25. The upper surfaces of teeth 29 of comb 28 are covered with a frictional material which insures holding the wires 31 secure when the only tension thereon is their own weight, but which permits the wires to pull loose under the influence of a moderately greater tension, such as might be supplied by an operator pulling on the downstream side.

After the entire set of twisted pairs 31 has been dressed through the appropriate ones of retaining clips 87 and connected to the appropriate ones of connector blocks 84, the terminal block in retaining device 35 can be dressed through the channel 104 to the position shown in FIG. 6. At this time, a new connector block has already been affixed to the ends of wires 21 at retaining device 41 and hence the process described above can be repeated by lifting the new terminal block out of device 41, releasing the lock pins on rotors 13 in indexing head 12 and pulling the new terminal block down to holding device 35. The process described above can be repeated as often as is required to interconnect all of the desired backplane connectors 85 to external connectors such as connector 103.

In order to avoid excessive buildup of wires in clips 87 on door 82, tables 100 and 101 can, at a point approximately half-way through the wiring procedure, be moved to positions adjacent to door 81. This allows the process to be continued by using retaining clips 86 and by wiring from the opposite side of connector blocks 84.

When the wiring is entirely complete for cabinet 80, the cabinet can be removed from the work station and a new cabinet installed. Since the free ends of the twisted pairs 10 have already been connected at retaining device 41 to a new connector block, it is not necessary to manually rethread indexing head 12 at any time. This permits the process described above to be continuous, not only for a plurality of connectors for each cabinet, but for a plurality of cabinets such as, for example, on a production line. Moreover, using the apparatus and method of the present invention, it is not necessary for an operator to visually identify either the pairs or the members of the pairs in order to properly wire backplane 83. It is only necessary that the proper sequence of connections to connectors 85 be followed. This sequence can be simplified by wiring successive pairs in group 31 to corresponding connectors 85 on successive ones of connector blocks 84 on backplane 83.

When the backplane wiring is completed on cabinet 80, doors 81 and 82 can be closed to afford protection for the wiring and terminal connections. Retaining clips 86 and 87 hold the wire bundles off of the wiring plane 83 and out of the way of maintenance personnel who may later open doors 81 and 82 to perform testing or maintenance functions. The wire bundles in clips 86 and 87 can be further lashed using standard lashing cord if further compacting of the wire bundles is desirable.

I claim:

1. A method of wiring electrical apparatus with twisted pairs of insulated electrical conductors sequentially comprising the steps of:

(a) selectively indexing one end of each of said pairs and the members of each of said pairs in a preselected orientation;

(b) mass-terminating said one end of all of said conductors in an electrical connector;

(c) advancing said one mass-terminated end for a predetermined length; and (d) selectively indexing each of said pairs and the members of each of said pairs in said preselected orientation at said predetermined length, thereby to facilitate individually terminating each of said conductors at said predetermined length in said electrical apparatus.

2. The method of wiring electrical apparatus according to claim 15 wherein said steps of selectively indexing further comprises the steps of:

(a) threading the members of each said pair through axial threadways in a rotatable cylinder; and (b) locking each said cylinder to prevent rotation thereof.

3. The method of wiring electrical apparatus according to claim 16 further including the steps of:

(a) extending the preselected orientation of said members of said pairs; and (b) resiliently grasping the extended and oriented members of said pairs.

4. The method of wiring electrical apparatus according to claim 15 wherein said step of mass-terminating further comprises the steps of:

(a) positioning a slotted-beam connector to align the slotted beams with the members of said pairs; and (b) pressing each said member into the aligned one of said slotted beams.

5. The method of wiring electrical apparatus according to claim 18 further including the step of:

(a) cutting all of said pairs adjacent to said slotted-beam connector.

6. A method of wiring electrical apparatus with twisted pairs of insulated electrical conductors comprising the steps of (a) supplying a plurality of continuous twisted pairs of insulated electrical conductors to an indexing station, (b) presenting at said indexing station members of each of said pairs in a selected orientation for a first portion of their length, (c) terminating all of said conductors at said first portion in a first electrical connector and simultaneously severing each of said conductors on one side of said first connector, (d) moving said first electrical connector away from said indexing station to provide a length of said conductors therebetween, (e) again presenting at said indexing station the members of each of said pairs in said selected orientation for a second portion of their length displaced from said first portion, (f) terminating all of said conductors in a second electrical connector at said second portion and simultaneously severing each of said conductors on said one side of said second connector, (g) presenting in said selected orientation the severed ends of said conductors severed from said second connector and connected to said first connector to facilitate pair-at-a-time conductor-oriented termination of said severed ends, and (h) successively repeating steps (d), (e), (f), (g) and (h).

* * * * *